US007287874B2

(12) United States Patent
Irisawa

(10) Patent No.: US 7,287,874 B2
(45) Date of Patent: Oct. 30, 2007

(54) PORTABLE SIGNAL LIGHT, VEHICLE GUIDANCE TOOL AND VEHICLE GUIDANCE METHOD

(75) Inventor: Hideaki Irisawa, Tokyo (JP)

(73) Assignee: Sanriki Kogyo Kabushiki Kaisha, Tokyo (JP)

( * ) Notice: Subject to any disclaimer, the term of this patent is extended or adjusted under 35 U.S.C. 154(b) by 236 days.

(21) Appl. No.: 10/522,806

(22) PCT Filed: Jun. 18, 2004

(86) PCT No.: PCT/JP2004/008605

§ 371 (c)(1),
(2), (4) Date: Jan. 31, 2005

(87) PCT Pub. No.: WO2004/113789

PCT Pub. Date: Dec. 29, 2004

(65) Prior Publication Data

US 2006/0092623 A1 May 4, 2006

(30) Foreign Application Priority Data

Jun. 23, 2003 (JP) ..... 2003-178061
Jul. 4, 2003 (JP) ..... 2003-191896

(51) Int. Cl.
*F21S 4/02* (2006.01)

(52) U.S. Cl. ..... 362/233; 362/109; 362/184; 340/815.45

(58) Field of Classification Search ..... 362/102, 362/109, 233, 800, 184, 577, 205; 340/815.45; 345/31

See application file for complete search history.

(56) References Cited

U.S. PATENT DOCUMENTS 5,622,423 A * 4/1997 Lee ..... 362/186

(Continued)

FOREIGN PATENT DOCUMENTS

JP 03-269902 A1 12/1991

(Continued)

OTHER PUBLICATIONS

International Search Report for PCT/JP2004/008605 mailed on Sep. 7, 2004.

(Continued)

*Primary Examiner*—Stephen F. Husar
*Assistant Examiner*—Peggy A. Neils
(74) *Attorney, Agent, or Firm*—Rader, Fishman & Grauer PLLC

(57) ABSTRACT

When using, an entire length from a grip portion to a light emitting lamp portion is elongated by drawing out the light emitting lamp portion from the grip portion so as to extend, and each of light emitting diodes in the light emitting lamp portion is turned so as to be usable by operating a main switch button in an infrared remote control sending apparatus. Further, a worker arranged at one point in a vehicle guiding section switches a color of emitted light of the light emitting lamp portion in a portable signal light, whereby the emitted light is switched to a blue "GO" display allowing a vehicle to move forward or a red "STOP" display inhibiting the vehicle from moving forward. Accordingly, it is possible to safely and smoothly guide the vehicle only by one worker.

7 Claims, 12 Drawing Sheets

U.S. PATENT DOCUMENTS

| | | | | |
|---|---|---|---|---|
| 5,973,618 | A * | 10/1999 | Ellis | 340/990 |
| 6,265,984 | B1 * | 7/2001 | Molinaroli | 340/815.4 |
| 6,293,684 | B1 * | 9/2001 | Riblett | 362/184 |
| 6,404,409 | B1 * | 6/2002 | Solomon | 345/31 |
| 2004/0062039 | A1 * | 4/2004 | Ahn | 362/192 |

FOREIGN PATENT DOCUMENTS

| | | | |
|---|---|---|---|
| JP | 06-299518 | A1 | 10/1994 |
| JP | 08-161651 | A1 | 6/1996 |
| JP | 10-049797 | A1 | 2/1998 |
| JP | 10-321002 | A1 | 12/1998 |
| JP | 11-066924 | A1 | 3/1999 |
| JP | 3073098 | U | 11/2000 |
| JP | 2001-023050 | A1 | 1/2001 |

OTHER PUBLICATIONS

International Search Report for PCT/JP2004/008605 (Japanese) mailed on Sep. 7, 2004.

* cited by examiner

PORTABLE SIGNAL LIGHT, VEHICLE GUIDANCE TOOL AND VEHICLE GUIDANCE METHOD

TECHNICAL FIELD

The present invention relates to a portable signal light, vehicle guidance tool and a vehicle guidance method used for guiding a vehicle in a road construction field, a construction work field, a parking area, a meeting place for event and the like.

BACKGROUND ART

Conventionally, in general, a portable signal light which a worker holds in a hand so as to send a signal to a vehicle driver has been used for a vehicle guidance work in the road construction field, the construction work field, the parking area, the meeting place for event and the like. As the portable signal light, there has been conventionally in general known a structure in which a plurality of light emitting diodes are installed in a cylindrical light emitting lamp portion continuously provided in a grip portion (for example, patent document 1). In this kind of portable signal light, in general, a battery serving as a power source of the light emitting diode is received within the grip portion, and a switch for turning on the light emitting diode is arranged so as to face to an outer surface of the grip portion. Further, the battery and the switch are connected to each of the light emitting diodes via a wire extending to an inner side of the light emitting lamp portion from an inner side of the grip portion. Further, in this kind of portable signal light, the light emitting lamp portion generally emits light by one color such as a red color or the like.

Patent Document 1: Japanese Unexamined Patent Publication No. 08-161651

Patent Document 2: Japanese Unexamined Patent Publication No. 2001-023050

DISCLOSURE OF THE INVENTION

Problem to be Solved by the Invention

In this case, conventionally, the generally known portable signal light including the portable signal light described in the patent document 1 is structured such that an entire length is comparatively short taking a portability into consideration. However, in the case of controlling the traffic by using the short portable signal light, it is necessary that the worker works so as to hang out to a traffic lane side or hold his or her hand up high such that the light emitting lamp portion of the portable signal light can be visible from a far vehicle. Further, even if the worker holds his or her hand up high, it is impossible to hold up the light emitting lamp portion at a higher position.

From this circumstance, in the working field of the traffic control using the portable signal light, there is requested a portable signal light which can be safely and effectively used by elongating the entire length from the grip portion to the light emitting lamp portion, and does not deteriorate the portability.

In order to meet the request, there can be considered that the portable signal light is structured as a telescopic type, however, in this case, since the switch in the grip portion side and the light emitting diode in the light emitting lamp side are connected by the wire, it is hard to obtain the telescopic structure.

Further, in the case of the portable signal light in which the light emitting lamp portion emits light by one color such as the red color or the like, there is a case that the vehicle driver can not clearly recognize whether the signal means "go-ahead" or "stop" at a time when the worker swings the portable signal light, so that there is a case that the vehicle guidance can not be smoothly executed.

As a matter of fact, in the case of using the portable signal light (for example, patent document 2) in which the color of the emitting light in the light emitting lamp portion can be switched between two colors, for example, between a red color and a blue color, it is possible to clarify the signals of "go-ahead" and "stop".

However, even if the portable signal light described in the patent document 2 is used, it is necessary to arrange two workers holding the portable signal lights in two positions comprising one spot and the other spot of the guide section, for the purpose of smoothly guiding the vehicle in the road construction field. Further, in the case that two workers are arranged as mentioned above, it is necessary to switch the color of the emitting light of the portable signal light while two workers work with each other, in order to prevent two workers from simultaneously setting the colors of the emitting lights of the portable signal lights so as to give signs of "go-ahead". Accordingly, the guidance work of the vehicle by the worker is complicated.

Accordingly, an object of the present invention is to provide a portable signal light in which an entire length from a grip portion to a light emitting lamp portion can be made longer at a time when the portable signal light is used, and the entire length can be made shorter at a time when the portable signal light is not used.

Further, the other object of the present invention is to provide a vehicle guidance tool and a vehicle guidance method which can safely and smoothly guide the vehicle by one worker.

Means for Solving the Problem

As a means for achieving the objects mentioned above, a portable signal light in accordance with a first aspect of the present invention is structured such as to be provided with a tubular light emitting lamp portion which is telescopically fitted to a tubular grip portion. The light emitting lamp portion has a battery for a power source and a plurality of light emitting diodes which can be turned on by the battery built-in. The grip portion is provided with an infrared remote control sending apparatus for controlling the lighting of the light emitting diode, and the light emitting lamp portion is provided with an infrared remote control receiving apparatus for receiving the control signal from the infrared remote control sending apparatus so as to control the lighting of the light emitting diode.

The infrared remote control sending apparatus can be detachably provided in the grip portion.

In the portable signal light mentioned above, when being used, the entire length from the grip portion to the light emitting lamp portion becomes longer by drawing out the light emitting lamp portion from the grip portion so as to elongate, and each of the light emitting diodes in the light emitting lamp portion is turned on so as to be used by operating the infrared remote control sending apparatus attached to the grip portion in this elongated state. On the other hand, when the portable signal light is not used, the entire length becomes shorter by pressing the light emitting light portion into the grip portion so as to contract.

Further, the structure may be made such that the portable signal light is provided with a tubular or bar-like support portion which is telescopically fitted to the tubular grip portion, and the support portion is provided with the light emitting lamp portion which has a battery for a power source and a plurality of light emitting diodes which can be turned on by the battery built-in. Further, the grip portion is provided with the infrared remote control sensing apparatus for controlling the lighting of the light emitting diode, and the light emitting lamp portion is provided with the infrared remote control receiving apparatus for receiving the control signal from the infrared remote control sending apparatus so as to control the lighting of the light emitting diode.

The structure may be made such that the light emitting lamp portion is detachably mounted to the support portion. Further, the infrared remote control sending apparatus can be detachably provided in the grip portion.

In accordance with the portable signal light provided with the light emitting lamp portion in the support portion, the distance from the grip portion to the light emitting lamp portion provided in the support portion becomes longer by drawing out the support portion from the grip portion so as to elongate at a time of being used. Each of the light emitting diodes in the light emitting lamp portion is turned on so as to be available, by operating the infrared remote control sending apparatus provided in the grip portion in this elongated state. On the other hand, when the portable signal light is not used, the entire length becomes shorter by pressing the support portion into the grip portion so as to contract.

In the case that the light emitting lamp portion is structured such as to be detachably mounted to the support portion, in the portable signal light provided with the light emitting lamp portion in the support portion, the support portion is sufficiently pressed into the grip portion by detaching the light emitting lamp portion from the support portion at a time when the portable signal light is not used. Accordingly, the entire length at a time of being brought with the user is preferably shorter.

A vehicle guidance tool in accordance with a second aspect of the present invention is structured such as to be provided with a portable signal light in which a color of emitting light of a light emitting lamp portion can be switched to at least two colors on the basis of an operation of an infrared remote control switch, and a barricade having an electric display portion which can be switched to at least two displays working with the operation of the infrared remote control switch.

In the portable signal light mentioned above and the portable signal light in the vehicle guidance tool, in the case that the infrared remote control sending apparatus is detachably provided in the grip portion, the operation can be easily executed by operating the infrared remote control sending apparatus in a state of being detached from the grip portion. In particular, in the case that the light emitting lamp portion is detachably mounted to the support portion, the distance from the grip portion to the light emitting lamp portion provided in the support portion becomes longer. Accordingly, it is advantageous to operate the infrared remote control sending apparatus in a state of being detached from the grip portion.

Further, a vehicle guidance method in accordance with a third aspect of the present invention is structured such that a worker operating the infrared remote control switch of the portable signal light is arranged in one spot in a section for guiding the vehicle, and the barricade is arranged in the other spot. When switching the light emitting lamp portion of the portable signal light to the color of the emitted light inhibiting the vehicle from moving forward on the basis of the operation of the infrared remote control switch by the worker, the electric display portion of the barricade is switched to the display allowing the vehicle to move forward working with this switch. When switching the light emitting lamp portion of the portable signal light to the color of the emitted light allowing the vehicle to move forward, the electric display portion of the barricade is switched to the display inhibiting the vehicle from moving forward working therewith.

In the vehicle guidance tool in accordance with the second aspect and the vehicle guidance method in accordance with the third aspect, a switching condition by the infrared remote control switch is previously set. For example, it is set such that when the light emitting lamp portion of the portable signal light is switched to the color (for example, the red color) of the emitted light inhibiting the vehicle from moving forward, the electric display portion of the barricade is switched to the display allowing the vehicle to move forward working with this switch, and when the light emitting lamp portion of the portable signal light is switched to the color (for example, the blue color) of the emitted light allowing the vehicle to move forward, the electric display portion of the barricade is changed to the display allowing the vehicle to move forward working with this switch. Further, the worker operating the infrared remote control switch of the portable signal light is arranged in one spot in the section for guiding the vehicle, and the barricade is arranged in the other spot.

In the vehicle guidance tool prepared in the manner mentioned above, when the worker arranged in one spot in the vehicle guiding section switches the light emitting lamp portion of the portable signal light to the color (for example, the red color) of the emitted light inhibiting the vehicle from moving forward, the electric display portion of the barricade arranged in the other spot of the vehicle guiding section is switched to the display allowing the vehicle to move forward. Further, when the worker switches the light emitting lamp portion of the portable signal light to the color (for example, the blue color) of the emitted light allowing the vehicle to move forward, the electric display portion of the barricade is switched to the display inhibiting the vehicle from moving forward.

Effect of the Invention

As described above, in the portable signal light in accordance with the first aspect, since the tubular light emitting lamp portion is provided so as to be telescopically fitted to the tubular grip portion, it is possible to make the entire length from the grip portion to the light emitting lamp portion longer so as to be safely used, at a time of being used. Further, when the portable signal light is not used, it is possible to make the entire length shorter so as to be brought with the user. Further, in the case that the light emitting lamp portion is detachably mounted to the support portion, the support portion is sufficiently pressed into the grip portion by detaching the light emitting lamp portion from the support portion at a time when the portable signal light is not used, so that it is possible to make the entire length at a time of being brought with the user shorter. Further, in the case that the infrared remote control sending apparatus is detachably attached to the grip portion, it becomes easy to operate the infrared remote control sending apparatus.

In the vehicle guidance tool in accordance with the second aspect and the vehicle guidance method in accordance with the third aspect, since the worker arranged in the one spot in the vehicle guiding section can switch the light emitting lamp portion of the portable signal light to the color of the emitted light inhibiting the vehicle from moving forward, or to the color of the emitted light allowing the vehicle to move forward, it is possible to safely and smoothly guide the vehicle by only one worker.

Figure 1:
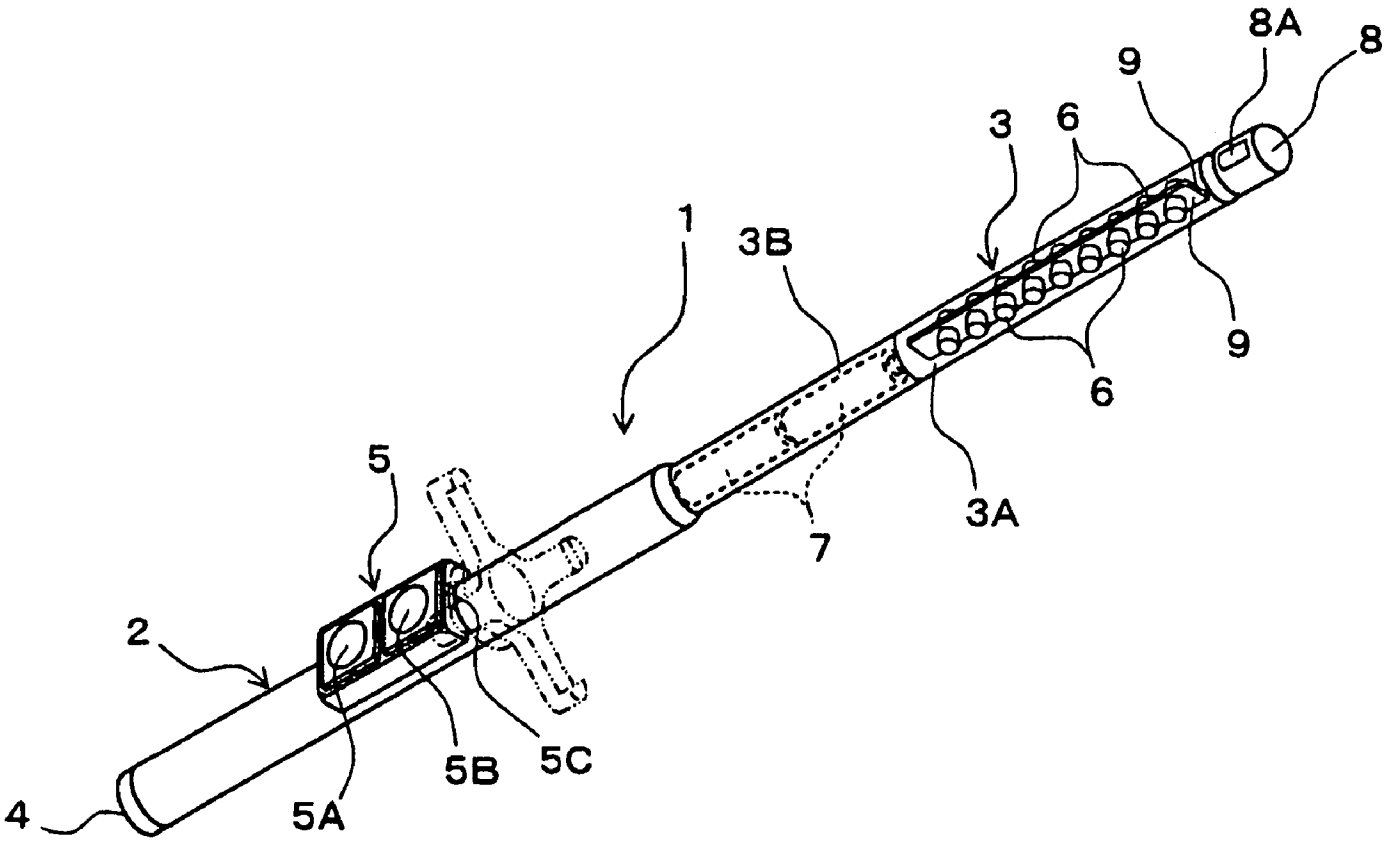
FIG. 1 is a perspective view of an elongated state showing a first embodiment of a portable signal light in accordance with the present invention.

| DESCRIPTION OF REFERENCE NUMERALS | |
|---|---|
| 1 | portable signal light |
| 2 | grip portion |
| 3 | light emitting lamp portion |
| 3A | leading end side |

-continued

| DESCRIPTION OF REFERENCE NUMERALS | |
|---|---|
| 3B | base end side |
| 4 | grip end |
| 5 | receiving case |
| 5A | main switch button |
| 5B | change switch button |
| 5C | infrared light sending window |
| 6 | light emitting diode |
| 7 | dry battery |
| 8 | head cap |
| 8A | infrared light receiving window |
| 9 | circuit board |
| 10 | stopper mechanism |
| 10A | stopper hole |
| 10B | stopper |
| 10C | coil spring |
| 10D | collar |
| 10E | positioning projection |
| 10F | circular recess portion |
| 10G | locking piece |
| 11 | receiving case |
| 12 | leaf spring |
| 13 | receiving case |
| 14 | hook-and-loop fastener |
| 21 | portable signal light |
| 22 | first support portion |
| 23 | second support portion |
| 24 | light emitting lamp portion |
| 24A, 24B | support frame |
| 24C | light emitting lamp portion |
| 24D | loading hole |
| 24E | resilient retaining ring |
| 101 | portable signal light |
| 102 | barricade |
| 103 | grip portion |
| 104 | light emitting lamp portion |
| 104A | infrared light receiving window |
| 105 | grip end |
| 106 | receiving case having infrared light remote control sending apparatus built-in |
| 106A | main switch button |
| 106B | change switch button |
| 107 | light emitting diode group |
| 107A | red color light emitting diode |
| 107B | blue color light emitting diode |
| 108 | head cap |
| 109 | circuit board |
| 110 | remote control receiving circuit |
| 111 | dry battery |
| 121 | A-type leg portion |
| 122 | transverse bar |
| 123 | electric display portion |
| 124 | electric display portion |
| 123A | blue color light emitting portion |
| 124A | red color light emitting portion |

BEST MODE FOR CARRYING OUT THE INVENTION

A description will be given below of an embodiment of a portable signal light in accordance with the present invention with reference to the accompanying drawings.

As shown in FIG. 1, a portable signal light 1 in accordance with a first embodiment is constituted by a two-stage telescopic type portable signal light, and is provided with a tubular light emitting lamp portion 3 fitted to an inner side of a tubular grip portion 2 so as to be telescopically slidable. The grip portion 2 is structured by a pipe made of a synthetic resin or a metal and having a suitable strength, for the purpose of receiving the light emitting lamp portion 3 so as to protect, and an opening of a base end portion thereof is closed by a grip end 4. Further, a receiving case 5 of an infrared remote control sending apparatus is provided in an outer peripheral surface of the grip portion 2.

On the other hand, the light emitting lamp portion 3 is structured by a transparent pipe made of a synthetic resin and receiving a plurality of light emitting diodes 6 and dry batteries 7 and 7 serving as a power source of the light emitting diodes, and an opening in a leading end portion thereof is closed by a head cap 8.

A plurality of light emitting diodes 6 are arranged in a line each of two circuit boards 9 and 9 having a long plate shape, and each of the circuit boards 9 and 9 is received in a leading end side 3A within the light emitting lamp portion 3 in a back-to-back state in which the light emitting diode 6 is directed to an outer side. Further, a light diffusion film (not shown) making a color development of the light emitting diode 6 clear is coated on an inner surface (or an outer surface) of the leading end side 3A of the light emitting lamp portion 3. In this case, the light emitting diode 6 generally employs one emitting light by a red color, however, may employ one emitting light by the other color such as a blue color, a green color, a yellow color and the like.

Further, the dry batteries 7 and 7 are arranged in series so as to be received in a base end side 3B within the light emitting lamp portion 3. Further, a painting for blindfold such as a silver color, a white color and the like is applied to an inner surface (or an outer surface) of the base end side 3B of the light emitting lamp portion 3 so as to cover the dry batteries 7 and 7.

In this case, an infrared remote control sending apparatus having a remote control sending circuit in which a button battery (not shown) is set as a power source is installed within the receiving case 5. Further, a main switch button 5A for turning on and off the lighting of each of the light emitting diodes 6 within the light emitting lamp portion 3, and a change switch button 5B for switching a lighting state of each of the light emitting diodes 6 to a continuous lighting and a flash lighting are arranged in an upper surface of the receiving case 5. Further, an infrared light sending window 5C is arranged in a leading end surface of the receiving case 5.

On the other hand, an infrared light receiving window 8A is provided as an infrared light receiving apparatus in the head cap 8 in the leading end of the light emitting lamp portion 3, and a remote control receiving circuit (not shown) is structured on each of the circuit boards 9 and 9 within the light emitting lamp portion 3. Further, the batteries 7 and 7 and the circuit boards 9 and 9 are connected via the remote control receiving circuit so as to turn on each of the light emitting diodes 6.

Figure 2:
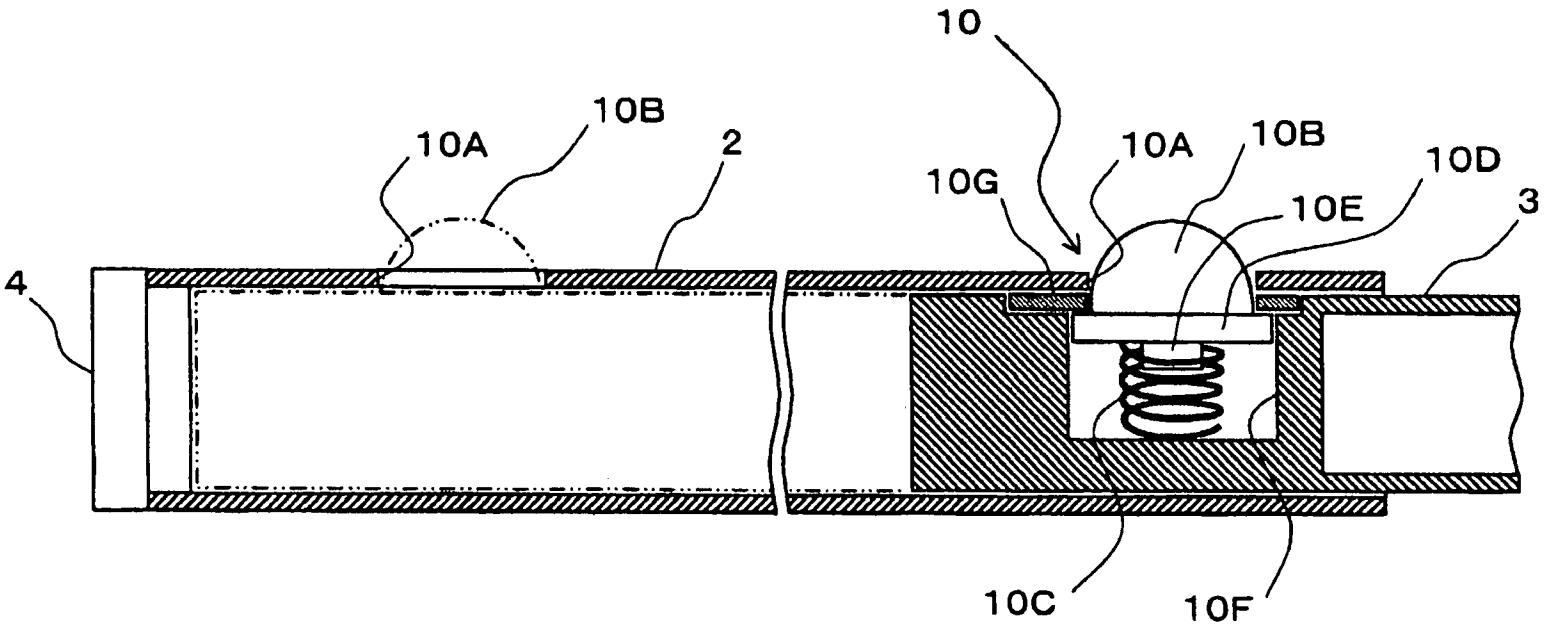
FIG. 2 is a partly enlarged cross sectional view showing a structure of a stopper mechanism of the portable signal light shown in FIG. 1.

In this case, in order to hold the light emitting lamp portion 3 at an elongated position where the light emitting lamp portion 3 is drawn out from the grip portion 2 and a contracted position where the light emitting lamp portion 3 is pressed into the grip portion 2, a stopper mechanism 10 shown in FIG. 2 is structured between the grip portion 2 and the light emitting lamp portion 3.

The stopper mechanism 10 is structured such as to be provided with two circular stopper holes 10A and 10A which are arranged linearly on peripheral surfaces of the leading end portion and the base end portion of the grip portion 2 so as to be open, one semispherical stopper 10B which is fitted to each of the stopper holes 10A from an inner side so as to be locked, a coil spring 10C which energizes the stopper 10B so as to fit to the stopper hole 10A, and the like.

A come-off preventing collar 10D and a positioning projection 10E of the coil spring 10C are formed in a base end portion in a side of the coil spring 10C of the stopper 10B. Further, the collar 10D of the stopper 10B is received within a circular recess portion 10F open to a peripheral surface of a base end portion of the light emitting lamp portion 3 together with the coil spring 10C so as to be slidable.

In order to prevent the stopper 10B mentioned above from coming off, a locking piece 10G locking the stopper 10B in a peripheral portion of a circular hole coinciding with the stopper hole 10A is attached to an opening portion of the circular recess portion 10F. The locking piece 10G is fitted to a peripheral surface so as to be approximately flush with the peripheral surface of the light emitting lamp portion 3.

In this case, although an illustration is omitted, a guide groove is formed on an inner surface of the grip portion 2 and a projection guided by the guide groove is provided in an outer surface of the base end portion of the light emitting lamp portion 3, in order to straightly slide the light emitting lamp portion 3 in a telescopic manner with respect to the grip portion 2.

The portable signal light 1 in accordance with the first embodiment structured as mentioned above is used for a traffic control in a road construction field, a construction work field or the like. In this use, the light emitting lamp portion 3 is straightly drawn out from the grip portion 2 so as to be elongated. Then, the stopper 10B in the base end portion of the light emitting lamp portion 3 structuring the stopper mechanism 10 is fitted into the stopper hole 10A in the leading end portion of the grip portion 2 (refer to FIG. 2). The light emitting lamp portion 3 is held at the elongated position in this way (refer to FIG. 1).

When operating the main switch button 5A on the receiving case 5 arranged in a side of the grip portion 2, each of the light emitting diodes 6 in a side of the light emitting lamp portion 3 is turned on, and the leading end side 3A of the light emitting lamp portion 3 emits light by a red color. Further, when operating the change switch button 5B in this state, each of the light emitting diodes 6 flashes, and the red color light in the leading end side 3A of the light emitting lamp portion 3 flashes.

In this used state mentioned above, since an entire length from the grip portion 2 to the light emitting lamp portion 3 becomes long in the portable signal light 1 in accordance with the first embodiment, the worker can place the light emitting lamp portion 3 at a position visible from a far vehicle without hanging out to a traffic lane side or holding his or her hand up high.

Figure 3:
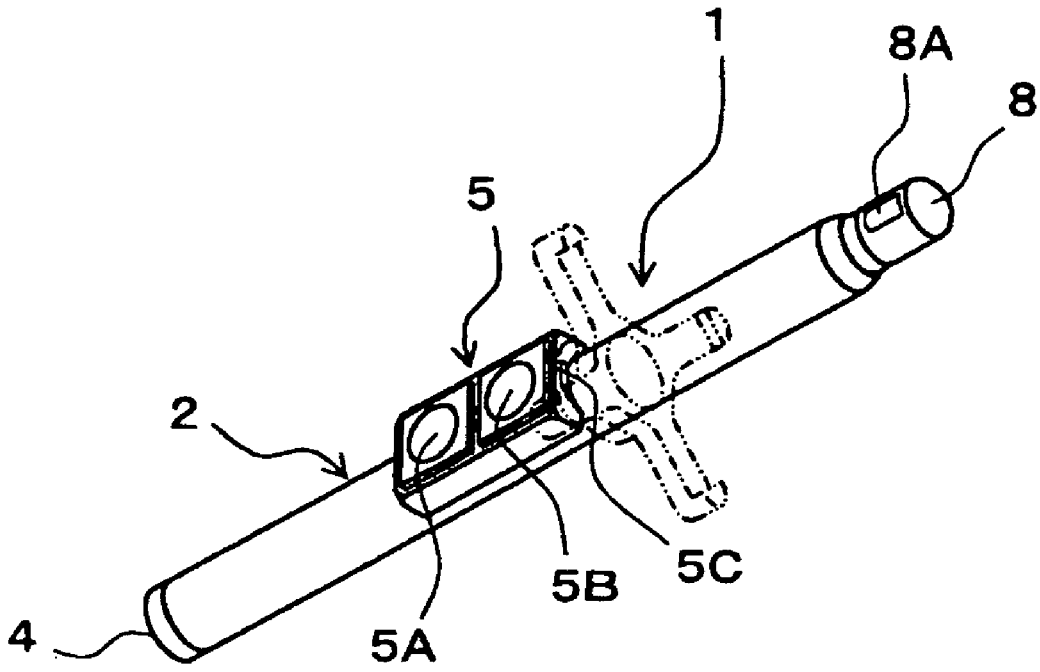
FIG. 3 is a perspective view of a contracted state of the portable signal light shown in FIG. 1.

On the other hand, when the portable signal light 1 is not used, the light emitting lamp portion 3 is straightly pressed into the grip portion 2 so as to be contracted. Then, the stopper 10B in the base end portion of the light emitting lamp portion 3 structuring the stopper mechanism 10 is fitted into the stopper hole 10A in the base end portion of the grip portion 2, whereby the light emitting lamp portion 3 is held at a contracted position (refer to FIG. 3). In this contracted state, the entire length of the portable signal light 1 becomes sufficiently short, and a portability is not deteriorated.

Next, a description will be given of a portable signal light in accordance with a second embodiment shown in FIG. 4. In this case, in the description of the portable signal light in accordance with the second embodiment, the same reference numerals are attached to the same constituting portions as those of the portable signal light 1 in accordance with the first embodiment, and a detailed description thereof will be omitted.

Figure 4:
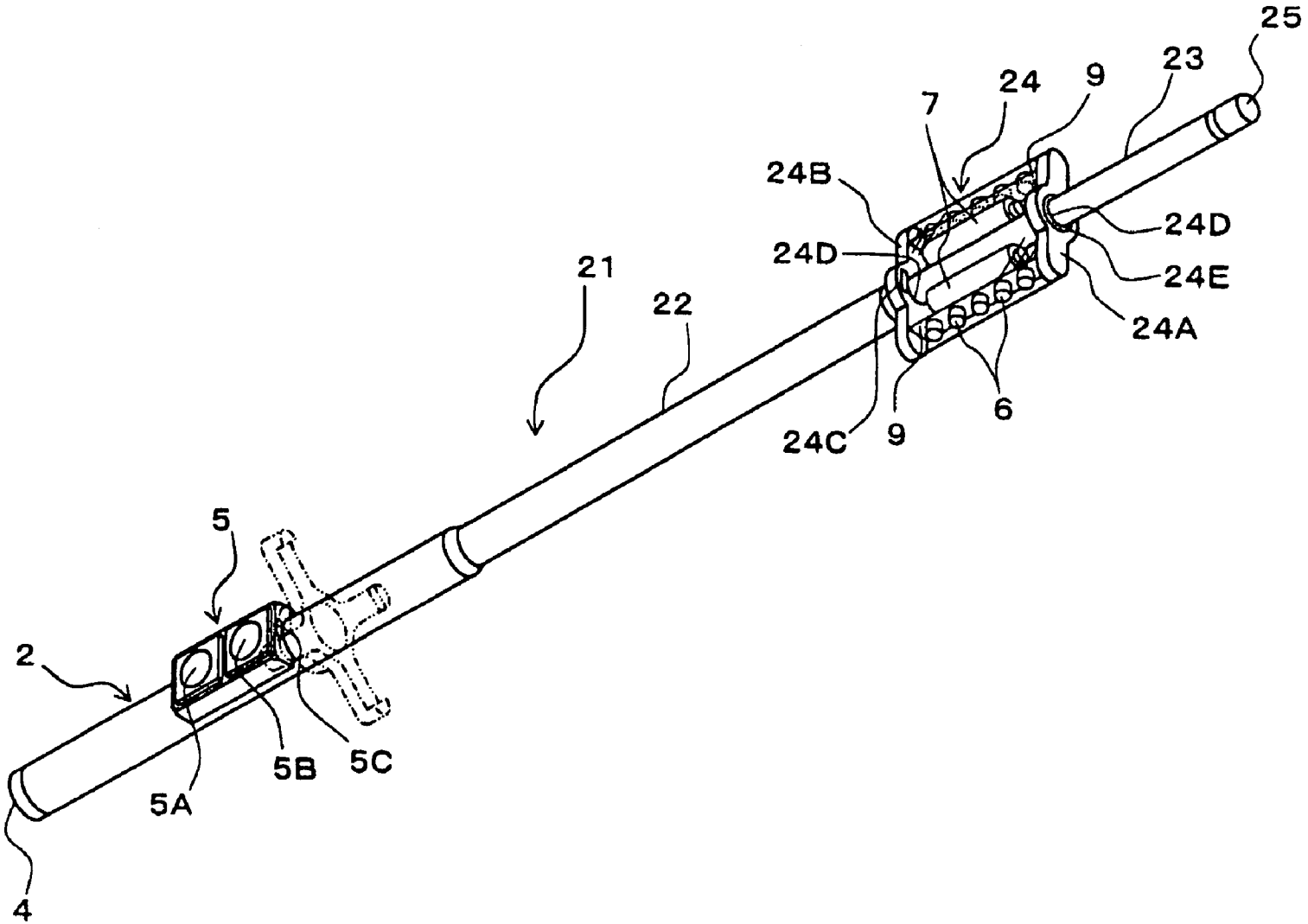
FIG. 4 is a perspective view of a portable signal light in accordance with a modified embodiment of the present invention in an elongated state.

As shown in FIG. 4, a portable signal light 21 in accordance with the second embodiment is constituted by a three-stage telescopic type portable signal light, and is structured such as to be provided with a tubular first support portion 22 which is fitted to the tubular grip portion 2 so as to be telescopically slidable, a tubular second support portion 23 which is fitted to the first support portion 22 so as to be telescopically slidable, and a light emitting lamp portion 24 which is detachably mounted to the second support portion 23. An opening in a leading end portion of the second support portion 23 is closed by a head cap 25.

The first support portion 22 and the second support portion 23 are structured by a pipe made of a synthetic resin or a metal having a suitable strength. Further, the grip portion 2, the first support portion 22 and the second support portion 23 are fitted so as to be telescopically slidable with each other by the same stopper mechanism as the stopper mechanism 10 shown in FIG. 2.

In this case, the light emitting lamp portion 24 is structured in a flat tubular shape by a synthetic resin in such a manner that a portion between front and rear support frames 24A and 24B is transparent, and is formed in an entirely flat box shape. Further, two circuit boards 9 and 9 each having a plurality of light emitting diodes 6 arranged in one line and having a long plate shape, and dry batteries 7 and 7 connected as a power source to both the circuit boards 9 and 9 are received in an inner portion of the light emitting lamp portion 24.

The respective circuit boards 9 and 9 are arranged in both sides in a width direction within the light emitting lamp portion 24 in a state in which the light emitting diodes 6 are directed to an outer side, and the dry batteries 7 and 7 are arranged in a back surface side of each of the circuit boards 9 and 9. Further, a light diffusion film (not shown) making the light emission of the light emitting diode 6 clear is coated on an inner surface (or an outer surface) of the transparent synthetic resin portion between the support frames 24A and 24B of the light emitting lamp portion 24.

Further, as the infrared light receiving apparatus, an infrared light receiving window 24C is provided in the support frame 24B in a base end side of the light emitting light portion 24, and a remote control receiving circuit (not shown) is structured on each of the circuit boards 9 and 9 within the light emitting lamp portion 24. Further, the dry batteries 7 and 7 and each of the circuit boards 9 and 9 are connected so as to turn on each of the light emitting diodes 6 via the remote control receiving circuit.

In this case, as a structure for detachably mounting the light emitting lamp portion 24 to the second support portion 23, the structure is made as follows. The head cap 25 is structured such as to be detachably screwed into an opening in a leading end portion of the second support portion 23. Further, loading holes 24D and 24D detachably fitted to the second support portion 23 are formed in center portions of the front and rear support frames 24A and 24B. Further, a resilient retaining ring 24E (only one is illustrated) closely attached to the second support portion 23 elastically so as to hold a loaded state of the light emitting lamp portion 24 is firmly fixed to the opening portions of the loading holes 24D and 24D.

In the portable signal light 21 in accordance with the second embodiment structured as mentioned above, at a time of being used, the first support portion 22 and the second support portion 23 are sequentially drawn out from the grip portion 2 so as to be elongated. Then, the first support portion 22 and the second support portion 23 are held in the elongated state by a stopper mechanism (refer to FIG. 2). Then, the head cap 25 in a leading end of the second support portion 23 is detached and is fitted to the front and rear loading holes 24D and 24D of the light emitting lamp portion 24 from the leading end side of the second support portion 23. Further, the light emitting lamp portion 24 is attached to the second support portion 23 in a state of being positioned at a predetermined position in a longitudinal direction of the second support portion 23 by the resilient retaining ring 24E. In this case, after attaching the light emitting lamp portion 24, the head cap 25 is attached to the second support portion 23.

Further, the main switch button 5A on the receiving case 5 arranged in a side of the grip portion 2 is operated. Then, each of the light emitting diodes 6 in a side of the light emitting lamp portion 24 is turned on, and the peripheral surface of the light emitting lamp portion 24 emits light by a red color. Further, when operating the change switch button 5B in this state, each of the light emitting diodes 6 flashes, and the red color light in the peripheral surface of the light emitting lamp portion 24 flashes.

In this used state mentioned above, since a distance from the grip portion 2 to the light emitting lamp portion 24 becomes long in the portable signal light 21 in accordance with the second embodiment, the worker can place the light emitting lamp portion 3 at a position visible from a far vehicle without hanging out to a traffic lane side or holding his or her hand up high. On the other hand, when the portable signal light 21 is not used, the light emitting lamp portion 24 is detached from the second support portion 23 in accordance with an opposite procedure to the procedure mentioned above, and the second support portion 23 and the first support portion 22 are pressed into the portable signal light 21 so as to be contracted. Then, the first support portion 22 and the second support portion 23 are held in the contracted state by a stopper mechanism (refer to FIG. 2). In this contracted state, an entire length of the portable signal light 21 becomes sufficiently short, and a portability is not deteriorated.

The portable signal light in accordance with the invention is not limited to each of the embodiments mentioned above. For example, the stopper mechanism 10 shown in FIG. 2 can be changed to a mechanism as described in Japanese Unexamined Patent Publication No. 07-004893 and Japanese Unexamined Patent Publication No. 05-280896, and can be changed to a screw ring type holding a camera tripod mount in an elongated state.

Further, the portable signal light 1 in accordance with the first embodiment may be structured as the three-stage telescopic type such as the portable signal light 21 in accordance with the second embodiment, or may be structured as a multi-stage telescopic type having more stages. In the same manner, the portable signal light 21 in accordance with the second embodiment may be structured as a multi-stage telescopic type.

Further, the light emitting lamp portion 3 in the portable signal light 1 in accordance with the first embodiment may be structured such that a plurality of light emitting diodes 6 are arranged toward three surfaces of the peripheral surface thereof.

Further, a plurality of light emitting diodes 6 may be structured such that the light emitting diodes having different light colors such as a red color and a blue color are alternately arranged on the circuit board 9 in the same manner as a portable signal light mentioned below. In this case, the infrared remote control sending apparatus and receiving apparatus may be structured such as to switch the lighting of the red light emitting diode and the lighting of the blue light emitting diode, for example, on the basis of an operation of the change switch button 5B.

The light emitting lamp portion 24 in the portable signal light 21 in accordance with the second embodiment may be structured as an aspect that it pinches the second support portion 23, and may be changed to a structure that two half portions are integrally fastened by an appropriate fastening member such as a locking screw or the like. Further, the description is given of the case that the light emitting lamp portion 24 in the portable signal light 21 in accordance with the second embodiment is formed in the flat tubular shape, however, the shape is not necessarily limited to the flat tubular shape, but may be set to a cylindrical shape or the other optional shapes. In the case of employing the cylindrical light emitting lamp portion, the structure may be made such that the second support portion 23 is inserted to a center of the cylindrical light emitting lamp portion.

In this case, in the portable signal light 1 in accordance with the first embodiment, an organic EL element corresponding to a sheet-like light emitting element may be attached to an inner surface of the light emitting lamp portion 3 in place of the light emitting diode 6. In the same manner, in the portable signal light 21, the organic EL element may be attached to an inner surface of a transparent synthetic resin portion of the light emitting lamp portion 24 in place of the light emitting diode 6.

Figure 11:
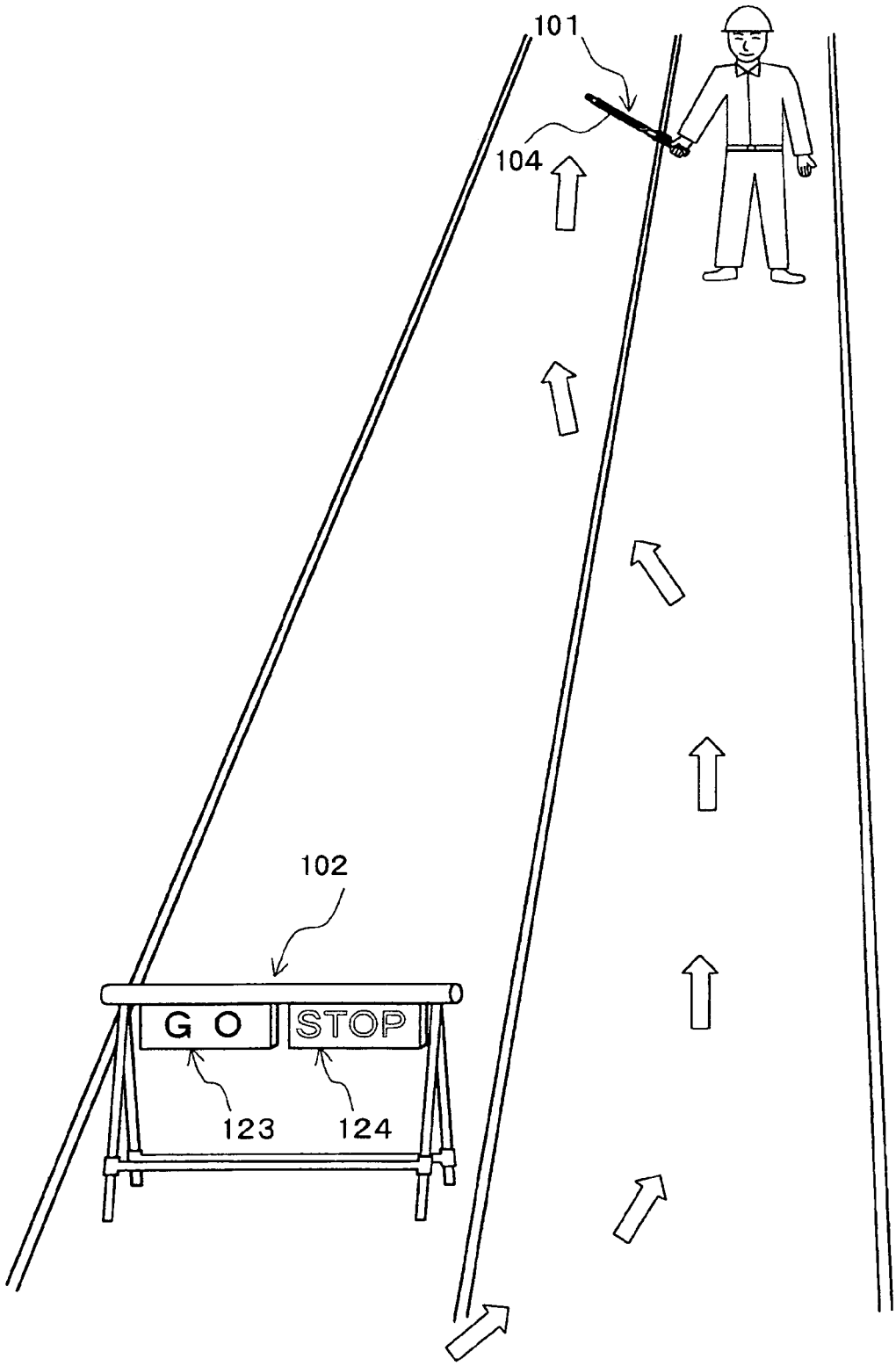
FIG. 11 is an explanatory view of a vehicle guidance method using a vehicle guidance tool in accordance with an embodiment.

Next, a description will be given of an embodiment of a vehicle guidance tool and a vehicle guidance method in accordance with the present invention with reference to the accompanying drawings. In the referred drawings, FIG. 5 is a perspective view of a vehicle guidance tool structuring a vehicle guidance tool in accordance with an embodiment, FIG. 6 is a perspective view of a barricade constituting a vehicle guidance tool in accordance with an embodiment, and FIG. 11 is an explanatory view of a vehicle guidance method using a vehicle guidance tool in accordance with an embodiment.

Figure 5:
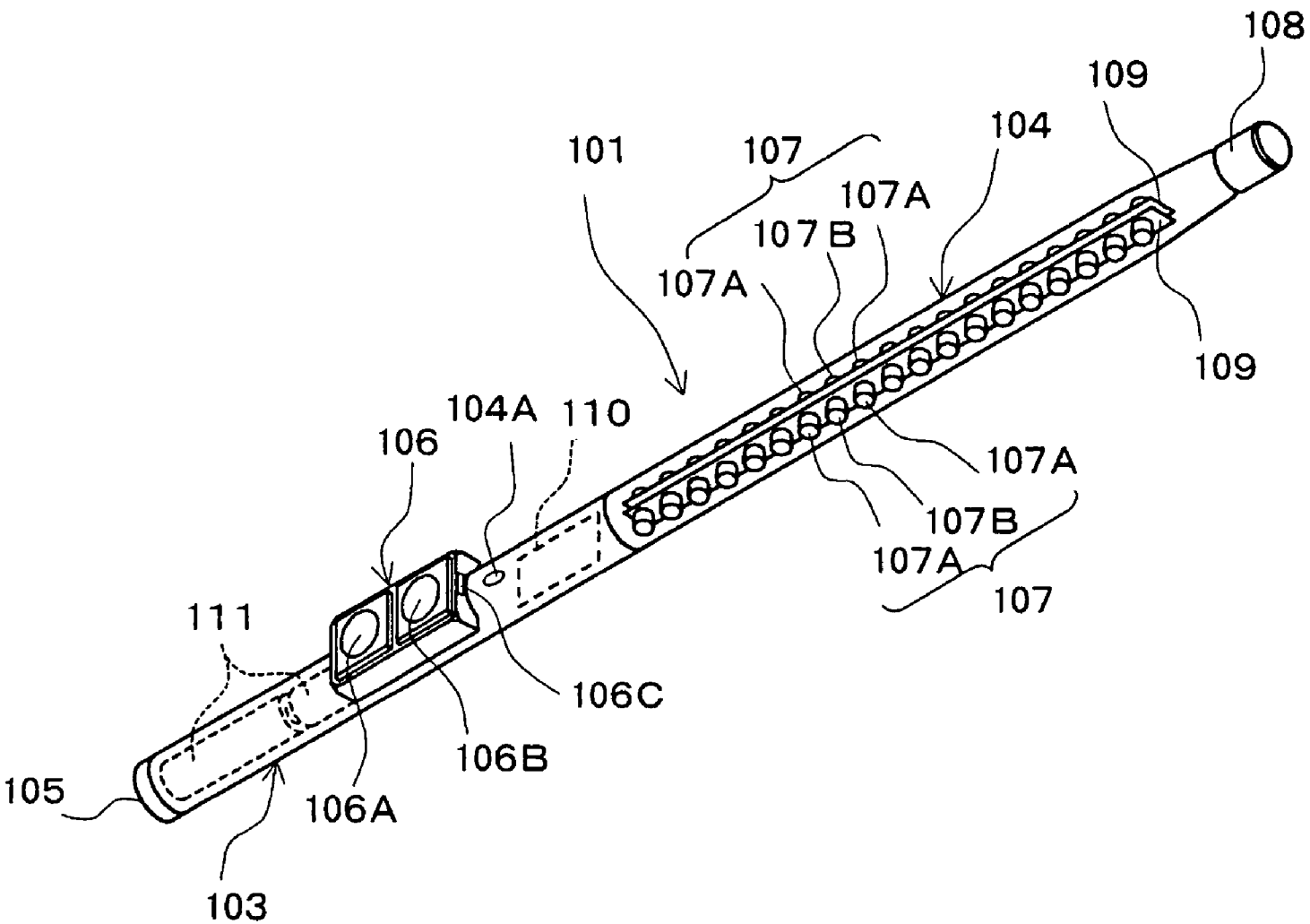
FIG. 5 is a perspective view of a portable signal light structuring a vehicle guidance tool in accordance with a second embodiment of the present invention.
Figure 6:
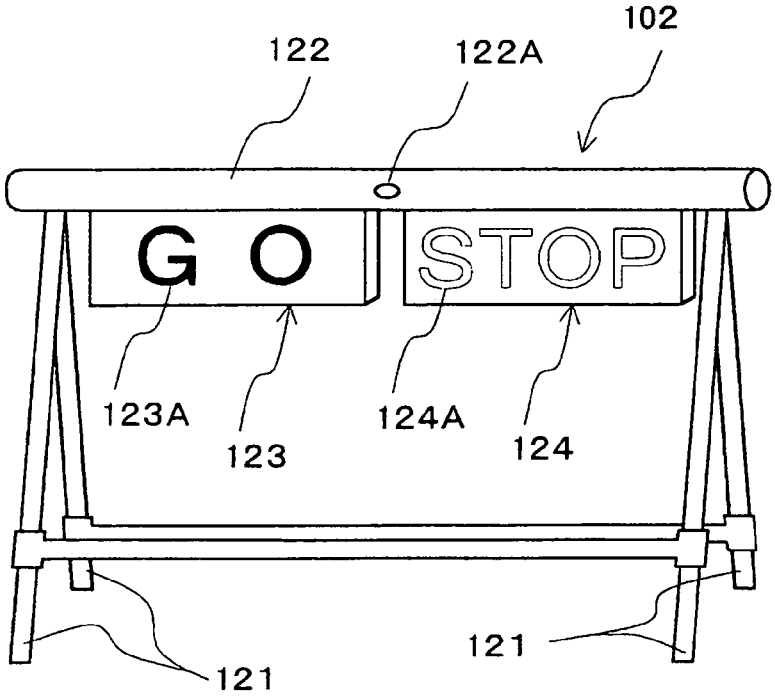
FIG. 6 is a perspective view of a barricade constituting a vehicle guidance tool in accordance with an embodiment.

The vehicle guidance tool in accordance with the embodiment is structured such as to be provided with a portable signal light 101 shown in FIG. 5, and a barricade 102 shown in FIG. 6. The portable signal light 101 shown in FIG. 5 is provided with a tubular light emitting lamp portion 104 connected to a tubular grip portion 103. The grip portion 103 is structured by a pipe made of a synthetic resin or a metal having a suitable strength, and an opening in a base end portion thereof is closed by a grip end 105. Further, a receiving case 106 having an infrared remote control sending apparatus in which an infrared remote control sending apparatus is received built-in is attached to an outer peripheral surface of the grip portion 103.

The light emitting lamp portion 104 is structured by a transparent pipe made of a synthetic resin and receiving a light emitting diode group 107 constituted by a plurality of light emitting diodes, and a head cap 108 is attached to an opening in a leading end portion thereof. The light emitting diode group 107 is arranged in a line on each of two circuit boards 109 and 109 having a long plate shape, and each of the circuit boards 109 and 109 is received within the light emitting lamp portion 104 in a back to back state in which the light emitting diode group 107 is directed to an outer side. Further, a light diffusion film (not shown) making the color of the emitted light of the light emitting diode 107 clear is covered on an inner surface (or an outer surface) of the light emitting lamp portion 104.

In this case, the light emitting diode group 107 is structured by alternately arranging a red color light emitting diode 107A for emitting light by a red color corresponding to a signal of "stop" in the light emitting lamp portion 103, and a blue color light emitting diode 107B for emitting light by a blue color corresponding to a signal of "go-ahead". In this case, the blue color light emitting diode 107B can be changed to a green color light emitting diode.

An infrared remote control sending apparatus having a remote control sending circuit having a button battery (not shown) as a power source is installed within the receiving case 106 having the infrared remote control sending apparatus built-in. Further, on an upper surface of the receiving case 106 having the infrared remote control sending apparatus built-in, there are arranged a main switch button 106A for turning on and off the lighting of the light emitting diode group 107 within the light emitting lamp portion 104, the red color light emitting diode 107A structuring the light emitting diode group 107, and a change switch button 106B for switching the lighting of the blue color light emitting diode 107B. Further, an infrared light sending window 106C is arranged in a leading end surface of the receiving case 106 having the infrared remote control sending apparatus built-in.

On the other hand, an infrared light receiving apparatus, an infrared light receiving window 104A is provided in an outer periphery of a base end portion of the light emitting lamp portion 104. A remote control receiving circuit 110 electrically connected to the infrared light receiving window 104A is received within the base end portion of the light emitting lamp portion 104. Further, dry batteries 111 and 111 serving as a power source for turning on the light emitting diode group 107 via the remote control receiving circuit 110 are arranged in series so as to be received within the grip portion 103. In this case, a blindfold paint such as a silver paint, a white paint or the like is applied to an inner surface (or an outer surface) of the base end portion of the light emitting lamp portion 104 in which the remote control receiving circuit 110 is received.

On the other hand, the barricade 102 shown in FIG. 6 is structured such as to be provided with a tubular transverse bar 122 supported by a pair of right and left A-type leg portions 121, and two electric display portion portions 123 and 124 fixed to a lower portion of the transverse bar 122. The transverse bar 122 is provided with an infrared light receiving window 122A receiving an infrared light signal sent from the infrared light sending window 106C of the receiving case 106 having the infrared light remote control sending apparatus of the portable signal light 101 shown in FIG. 5 built-in. The transverse bar 122 has a remote control receiving circuit electrically connected to the infrared light receiving window 122A and a battery (not shown) serving as a power source built-in.

One electric display portion 123 has a blue color light emitting portion 123A in which a plurality of blue color light emitting diodes are arranged in a shape of "GO" so as to display a sign of "go-ahead", and the other electric display portion 124 has a red color light emitting portion 124A in which a plurality of red color light emitting diodes are arranged in a shape of "STOP" so as to display a sign of "stop". The blue color light emitting portion 123A and the red color light emitting portion 124A are controlled in lighting on the basis of the control of the remote control receiving circuit (not shown) installed in the transverse bar 122.

In other words, the blue color light emitting portion 123A of the electric display portion 123 is controlled so as to be turned on in an interlocking manner at a time when the red color light emitting diode 107A of the light emitting lamp portion 104 of the portable signal light 101 (refer to FIG. 5) is turned on in accordance with the operation of the change switch button 106B of the infrared light remote control switch 106. Further, the red color light emitting portion 124A of the electric display portion 124 is controlled so as to be turned on in an interlocking manner at a time when the blue color light emitting diode 107B of the light emitting lamp portion 104 of the portable signal light 101 is turned on in accordance with the operation of the change switch button 106B of the receiving case 106 having the infrared light remote control sending apparatus built-in.

Figure 7:
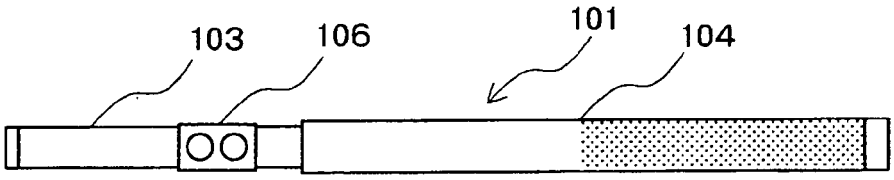
FIG. 7 is a plan view showing a second modified embodiment of a light emitting lamp portion of the portable signal light.
Figure 8:
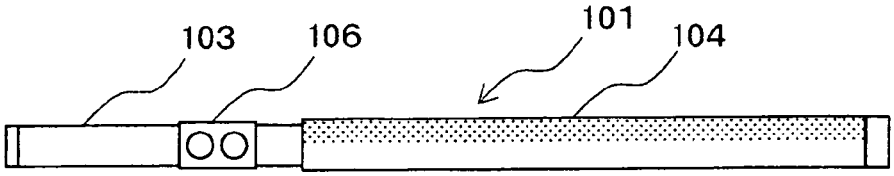
FIG. 8 is a plan view showing a third modified embodiment of the light emitting lamp portion of the portable signal light.

In this case, the portable signal light in accordance with the present invention is not limited to the embodiment mentioned above. For example, the light emitting lamp portions 3, 24 and 104 of the portable signal lights 1, 21 and 101 shown in FIGS. 1, 4 and 5 may be structured, as shown in FIG. 7, such that the leading end side emits light by the red color, and the base end side emits light by the blue color. Alternatively, the structure may be made, as shown in FIG. 8, such that one surface side emits light by the red color along an axis, and the other one surface side emits light by the blue color.

Figure 9:
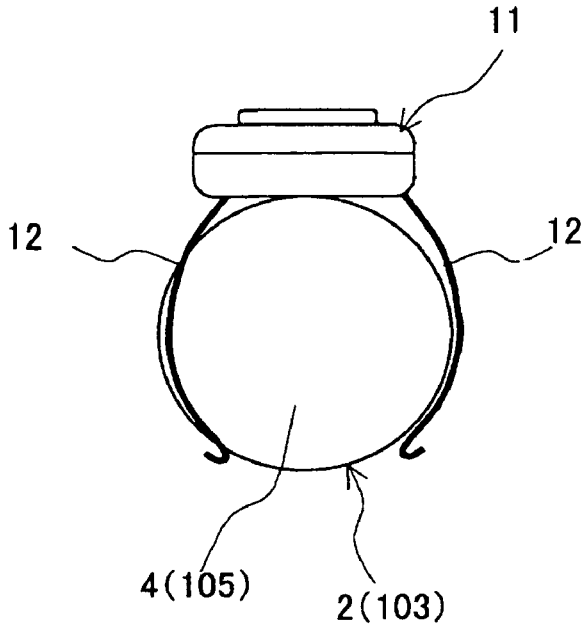
FIG. 9 is a view of a receiving case in accordance with a modified embodiment of a receiving case shown in FIGS. 1, 4 and 5 as seen from a grip end side.

Further, in the portable signal light 1, the portable signal light 21 and the portable signal light 101, the receiving cases 5 and 106 having the infrared remote control sending apparatus built-in can be changed to the receiving case 11 in accordance with a first modified embodiment shown in FIG. 9. The receiving case 11 is structured such as to be detachably mounted to the grip portions 2 and 103 by a pair of right and left leaf springs 12 and 12 which are curved along the peripheral surfaces of the grip portions 2 and 103.

Figure 10:
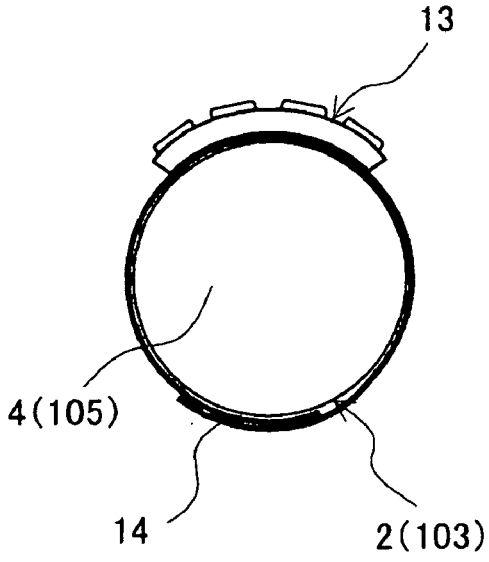
FIG. 10 is a view of a receiving case in accordance with a modified embodiment of the receiving case shown in FIGS. 1, 4 and 5 as seen from a grip end side.

Further, the receiving cases 5 and 106 can be changed to a receiving case 13 in accordance with a second modified embodiment shown in FIG. 10. The receiving case 13 is structured in a laterally long thin type which is curved along the peripheral surfaces of the grip portions 2 and 103, and is structured such as to be detachably mounted to the grip portions 2 and 103 by a tape-like hook-and-loop fastener 14.

The vehicle guidance tool in accordance with the embodiment structured in the manner mentioned above is used for a guidance work of the vehicle in the road construction field, for example, shown in FIG. 11. In this case, the worker operating while holding the portable signal light 101 is arranged at one point (a far point in FIG. 11) in the section for guiding the vehicle, and the barricade 102 is placed at the other point (a near point in FIG. 11) in the section for guiding the vehicle.

In accordance with the vehicle guidance method using the portable signal light 101 and the barricade 102 which are arranged in this manner, the worker operates so as to direct the infrared light sending window 106C toward the barricade 102 at a time of operating the change switch button 106B of the receiving case 106 in which the infrared light remote control sending apparatus attached to the portable signal light 101 is installed.

In accordance with the simple operation mentioned above, for example, in the case that the light emitting lamp portion 104 of the portable signal light 101 is switched to the blue emitted light allowing the vehicle to move forward, the electric display portion 124 of the barricade 102 is turned on so as to be switched to the red display of "STOP" inhibiting the vehicle from moving forward. Further, when the light emitting lamp portion 104 is switched to the red emitted light inhibiting the vehicle from moving forward, the electric display portion 123 of the barricade 102 is turned on so as to be switched to the blue display of "GO" allowing the vehicle to move forward.

Then, the vehicle (not shown) passes through the construction field at the rear of the barricade 102 as shown by an outline arrow shown in FIG. 11 while bypassing, whereby the vehicle is smoothly guided.

Figure 12:
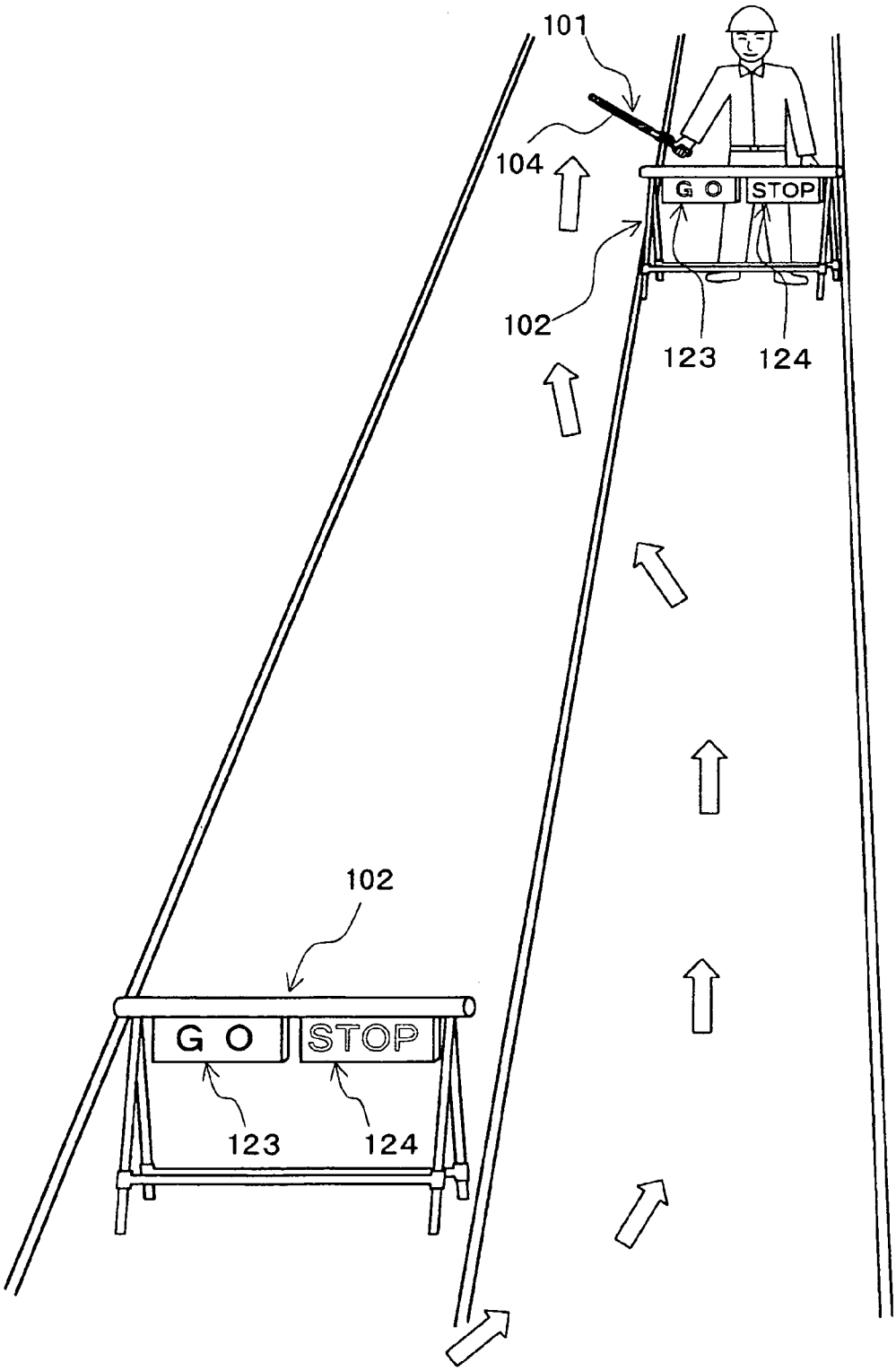
FIG. 12 is an explanatory view showing a modified embodiment of the vehicle guidance method shown in FIG. 11.

FIG. 12 shows a vehicle guidance method which is executed in a state in which one more barricade 102 is placed near the worker shown in FIG. 11. In this case, in the barricade 102 near the worker, when the light emitting lamp portion 104 of the portable signal light 101 held by the worker is switched to the blue emitted light allowing the vehicle to move forward, the electric display portion 123 is turned on so as to be switched to the blue display of "GO" allowing the vehicle to move forward. Further, when the light emitting lamp portion 104 is switched to the red emitted light inhibiting the vehicle from moving forward, the electric display portion 124 is turned on so as to be switched to the red display of "STOP" inhibiting the vehicle from moving forward.

Accordingly, in accordance with the vehicle guidance tool and the vehicle guidance method on the basis of the embodiment, in the road construction field, it is possible to safely and smoothly guide the vehicle even by one worker.

In this case, although an illustration is omitted, two workers each holding the portable signal light 101 can guide the vehicle by using four barricades 102. In this case, a pair of right and left barricades 102 and 102 are placed near both sides of a roadway at one point in the section for guiding the vehicle, and the first worker is arranged near the one side barricade 102. Further, a pair of barricades 102 and 102 are placed near both sides of the roadway at the other point in the section for guiding the vehicle, and the second worker is arranged near the one side barricade 102.

In accordance with the vehicle guidance method, when the first worker switches the light emitting lamp portion 104 of the portable signal light 101 held by himself or herself, the electric display portion 124 is turned on so as to be switched to the red display of "STOP" in the barricade 102 near the worker. At the same time, in the barricade 102 arranged at the other point in the vehicle guiding section in the same traffic lane as the barricade 102, the electric display portion 123 is turned on so as to be switched to the blue display of "GO".

Then, the second worker switches the light emitting lamp portion 104 of the portable signal light 101 held by himself or herself to the blue emitted light, after confirming that the electric display portion 123 of the barricade 102 placed at the other point in the vehicle guiding section is turned on so as to be switched to the blue display of "GO". Accordingly, in the barricade 102 near the second worker, the electric display portion 123 is turned on so as to be switched to the blue display of "GO" working therewith, and at the same time, in the barricade 102 arranged at the other point in the vehicle guiding section in the same traffic lane side as the barricade 102, the electric display portion 124 is turned on so as to be switched to the red display of "STOP".

Further, the barricade 102 shown in FIG. 6 can be changed to barricades 141 to 144 shown in FIGS. 13 to 16.

Figure 13:
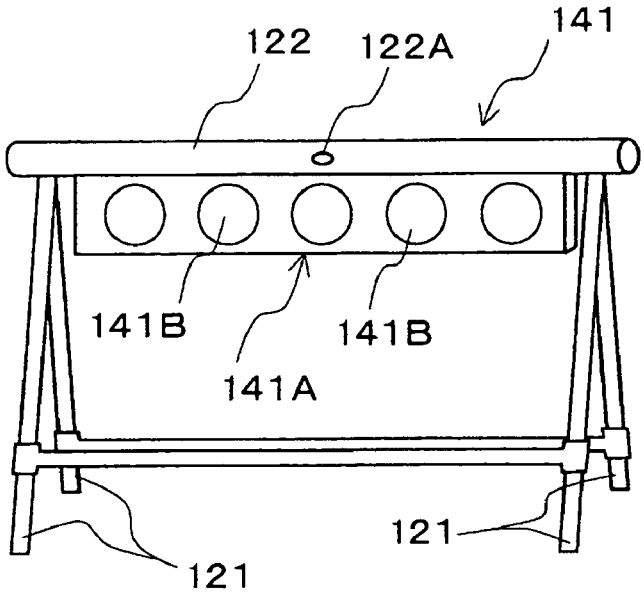
FIG. 13 is a perspective view showing a first modified embodiment of the barricade shown in FIG. 6.

The barricade 141 shown in FIG. 13 has the transverse bar 122 supported to a pair of right and left A-type leg portions 121 in the same manner as the barricade 102 shown in FIG. 6, and a laterally long plate-shaped electric display portion 141A is fixed to a lower portion of the transverse bar 122. Circular two-color light emitting portions 141B are arranged in a line laterally in the electric display portion 141A, the light emitting portions 141B being structured such that a lot of red light emitting diodes and blue light emitting diodes are closely arranged.

Figure 14:
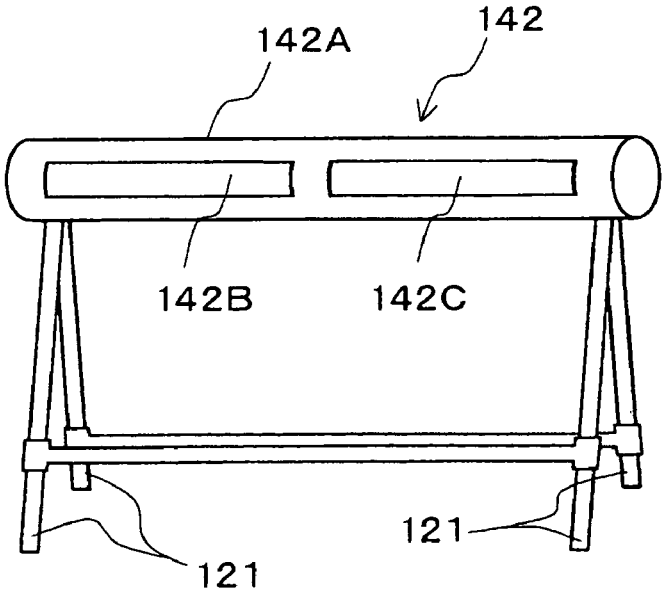
FIG. 14 is a perspective view showing a second modified embodiment of the barricade shown in FIG. 6.

The barricade 142 shown in FIG. 14 has a large-diameter transverse bar 142A supported to a pair of right and left A-type leg portions 121 in the same manner as the barricade 102 shown in FIG. 6. A pair of band-like two-color light emitting portions 142B and 142C are provided as the electric display portion in a peripheral surface of the transverse bar 142A, the light emitting portions 142B and 142C being structured such that a lot of red light emitting diodes and blue light emitting diodes are closely arranged.

Figure 15:
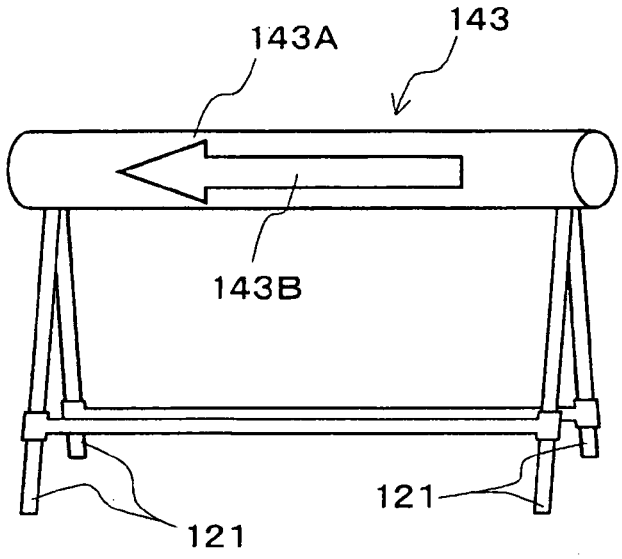
FIG. 15 is a perspective view showing a third modified embodiment of the barricade shown in FIG. 6.

The barricade 143 shown in FIG. 15 has a large-diameter transverse bar 143A supported to a pair of right and left A-type leg portions 121 in the same manner as the barricade 102 shown in FIG. 6. A two-color light emitting portion 143B is provided as the electric display portion in a peripheral surface of the transverse bar 142A, the light emitting portion 143B being structured such that a lot of red light emitting diodes and blue light emitting diodes are closely arranged in an arrow shape.

Figure 16:
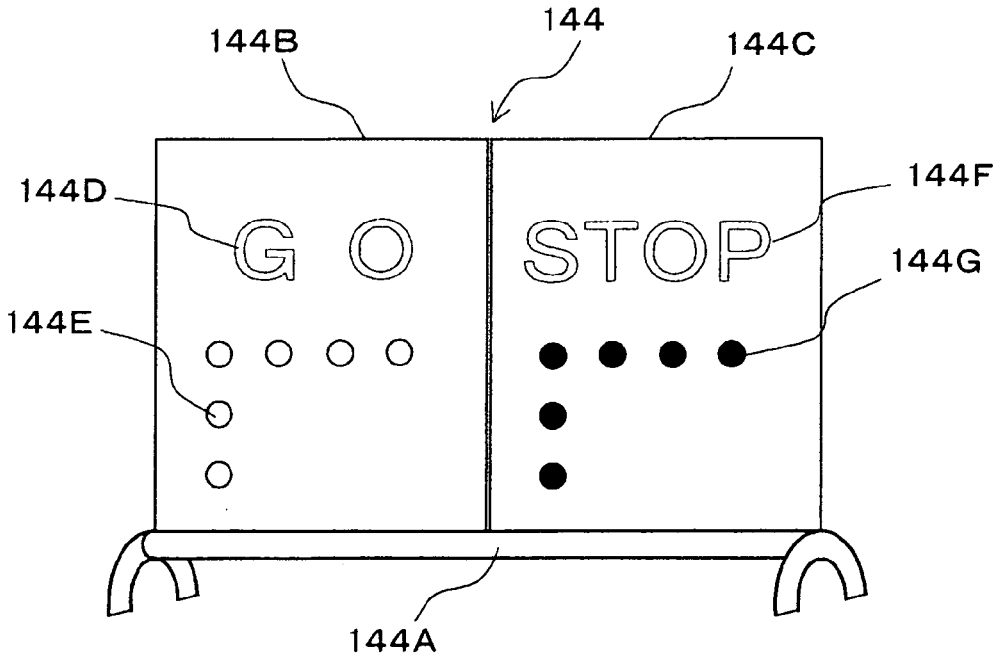
FIG. 16 is a perspective view showing a fourth modified embodiment of the barricade shown in FIG. 6.

The barricade 144 shown in FIG. 16 is provided with electric display plates 144B and 144C which are provided on a laterally long support leg 144A so as to be arranged right and left. One electric display plate 144B has a light emitting portion 144D formed in a shape of "GO" so as to display a signal of "go-ahead", and a blue light emitting portion 144E in which a plurality of blue light emitting diodes are collected in a circular point shape and arranged in a key shape. The other electric display plate 144C has a light emitting portion 144F formed in a shape of "STOP" so as to display a signal of "stop", and a red light emitting portion 144G in which a plurality of red light emitting diodes are collected in a circular point shape and arranged in a key shape.

Figure 17:
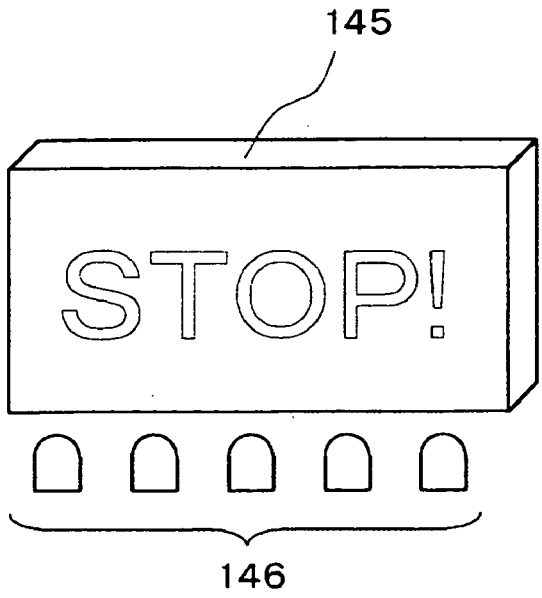
FIG. 17 is a perspective view showing a modified embodiment of an electric display portion.

In this case, the electric display portion can be structured, as shown in FIG. 17, by a transparent acrylic plate 145 inscribed, for example, by a character of "STOP", and a plurality of red light emitting diode groups 146 emitting light toward a lower surface of the transparent acrylic plate 145.

Figure 18:
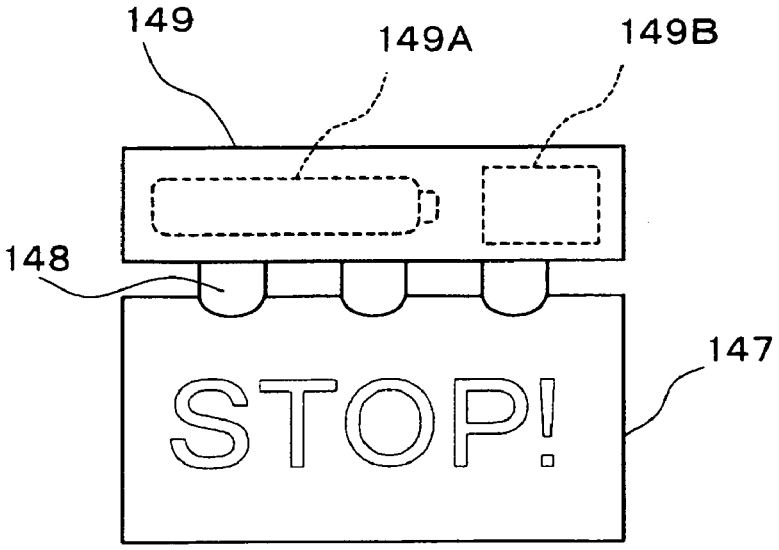
FIG. 18 is a perspective view showing the other modified embodiment of the electric display portion.

Further, the electric display portion can be structured, as shown in FIG. 18, by a plate 147 inscribed, for example, by a character of "STOP", a plurality of lights 148 lighting the plate 147 from the above, a power source box 149 having a battery 149A and a circuit portion 149B built-in, and the like.

Further, in the portable signal light 101 in accordance with the embodiment mentioned above, an organic EL element corresponding to a sheet-like light emitting element may be provided in the inner surface of the light emitting lamp portion 104, in place of the light emitting diode group 107. Since the tubular light emitting lamp portion telescopically fitted to the tubular grip portion is provided, it is possible to elongate the entire length from the grip portion to the light emitting lamp portion so as to safely use at a time of using, and it is possible to shorten the entire length so as to be brought therewith at a time when the portable signal light is not used.

Further, in the case that the light emitting lamp portion is detachably mounted to the support portion, the support portion can be sufficiently pressed into the grip portion by detaching the light emitting lamp portion from the support portion at a time when the portable signal light is not used. Accordingly, the entire length at a time of bringing the portable signal light can be made shorter. Further, in the case that the infrared remote control sending apparatus is detachably mounted to the grip portion, the infrared remote control sending apparatus can be easily operated.

INDUSTRIAL APPLICABILITY

Since the tubular light emitting lamp portion telescopically fitted to the tubular grip portion is provided, the entire length can be elongated so as to be used as the portable signal light which can securely guide. Further, it is possible to use as the vehicle guidance tool which can guide the vehicle only by one person in the road construction field, the construction work field, the parking area, the meeting place for event and the like.

What is claimed is:

1. A portable signal light, comprising:

a tubular light emitting lamp portion which is telescopically fitted to a tubular grip portion, the light emitting lamp portion defines a housing containing a battery for a power source and a plurality of light emitting diodes which can be turned on by the battery, said grip portion is provided with an infrared remote control sending apparatus operative for controlling the lighting of said plurality of light emitting diodes, and said light emitting lamp portion is provided with an infrared remote control receiving apparatus operative for receiving the control signal from said infrared remote control sending apparatus so as to control the lighting of said plurality of light emitting diodes, a main switch device mounted to the grip portion and operative to cause the infrared remote control sending apparatus to send an infrared signal to the remote control receiving apparatus to cause the plurality of light emitting diodes to either turn on or turn off, and a change switch device mounted to the grip portion and operative to switch the turn-on plurality of light emitting diodes between a continuous lighting state and a flashing lighting state.

2. A portable signal light, comprising:

a tubular or bar-like support portion which is telescopically fitted to a tubular grip portion, and the support portion is provided with a light emitting lamp portion defining a housing containing a battery for a power source and a plurality of light emitting diodes which can be turned on by the battery, said grip portion is provided with an infrared remote control sending apparatus operative for controlling the lighting of said plurality of light emitting diodes, and said light emitting lamp portion is provided with the infrared remote control receiving apparatus operative for receiving the control signal from said infrared remote control sending apparatus so as to control the lighting of said plurality of light emitting diodes, wherein the light emitting lamp portion is detachably mounted to the support portion.

3. A portable signal light as claimed in claim 1 or 2, wherein said infrared remote control sending apparatus is detachably provided in said grip portion.

4. A portable signal light comprising:

a portable signal light is provided with a tubular or bar-like support portion which is telescopically fitted to a tubular grip portion, and the support portion is provided with a light emitting lamp portion defining a housing containing a battery for a power source and a plurality of light emitting diodes which can be turned on by the battery, said grip portion is provided with an infrared remote control sending apparatus operative for controlling the lighting of said plurality of light emitting diodes, and said light emitting lamp portion is provided with the infrared remote control receiving apparatus operative for receiving the control signal from said infrared remote control sending apparatus so as to control the lighting of said plurality of light emitting diodes, a main switch device mounted to the grip portion and operative to cause the infrared remote control sending apparatus to send an infrared signal to the remote control receiving apparatus to cause the plurality of light emitting diodes to either turn on or turn off, and a change switch device mounted to the grip portion and operative to switch the turn-on plurality of light emitting diodes between a continuous lighting state and a flashing lighting state.

5. A portable signal light as claimed in claims 1 or 4, further comprising a receiving case connected to the grip portion, the receiving case sized to receive the main switch device and the change switch device.

6. A portable signal light as claimed in claim 5, wherein the receiving case has an infrared light sending window and houses the infrared remote control sending apparatus therein.

7. A portable signal light as claimed in claims 1 or 2, wherein the light emitting lamp portion includes a head disposed at a distal end of the light emitting lamp portion, the head having an infrared light receiving window and housing the infrared remote control receiving apparatus therein.

* * * * *